US011840374B2

(12) United States Patent
Bungard

(10) Patent No.: US 11,840,374 B2
(45) Date of Patent: Dec. 12, 2023

(54) CONTAINER SYSTEM

(71) Applicant: Damon Bungard, Spencer, TN (US)

(72) Inventor: Damon Bungard, Spencer, TN (US)

( * ) Notice: Subject to any disclaimer, the term of this patent is extended or adjusted under 35 U.S.C. 154(b) by 0 days.

(21) Appl. No.: 17/481,882

(22) Filed: Sep. 22, 2021

(65) Prior Publication Data

US 2022/0097909 A1 Mar. 31, 2022

Related U.S. Application Data

(60) Provisional application No. 63/083,529, filed on Sep. 25, 2020.

(51) Int. Cl.
*B65D 21/02* (2006.01)

(52) U.S. Cl.
CPC ..... *B65D 21/0233* (2013.01); *B65D 21/0234* (2013.01)

(58) Field of Classification Search
CPC .... B65D 21/0233; B65D 11/16; B65D 25/02; B65D 81/203; B65D 21/0209; B65D 21/0234; B65D 21/0216; B65D 21/0228; B65D 21/0237; B65D 21/04; B65D 21/0212; B65D 21/0222; B65D 21/0223
USPC ..... 220/573.4, 574.3, 574, 592.15, 592.26, 220/23.89, 23.87, 23.86, 23.83, 527, 528; 206/585, 514, 517
See application file for complete search history.

(56) References Cited

U.S. PATENT DOCUMENTS 4,429,798 A * 2/1984 Borows ..... B65D 41/045 215/12.1
5,392,948 A * 2/1995 McEntee ..... A47J 43/0727 222/572
5,560,315 A 10/1996 Lampe
5,701,757 A * 12/1997 Heverly ..... B65D 81/382 220/592.2
5,749,500 A * 5/1998 Kraus ..... B65D 25/02 222/464.7
6,092,719 A * 7/2000 Capo ..... B65D 5/2047 229/114
6,405,675 B1 6/2002 Mills
7,387,082 B1 6/2008 Fried
7,634,973 B1 12/2009 Cribb et al.
7,959,866 B2 * 6/2011 Crawford ..... B01L 3/5082 422/550
D682,482 S 5/2013 Nelson
9,326,625 B1 * 5/2016 Esfahani ..... A47G 19/02
(Continued)

*Primary Examiner* — Robert Poon
(74) *Attorney, Agent, or Firm* — Meunier Carlin & Curfman LLC

(57) ABSTRACT

Various implementations include a container system that includes a first and second bowl. The first bowl has a resilient wall that is urgable radially outwardly from a resting position to an expanded position. The edge of the resilient wall spaced apart from a first bowl base has a resting perimeter length and an expanded perimeter length. A rigid wall of the second bowl has a first edge spaced apart from a second bowl base and a second edge opposite the rigid wall first edge each have a perimeter length. The perimeter lengths of the rigid wall are both greater than or equal to the resting perimeter length and are less than or equal to the expanded perimeter length. A groove is defined by the resilient wall and/or rigid wall. A protrusion extends along the other of the rigid wall and/or resilient wall. The protrusion is engageable within the groove.

16 Claims, 8 Drawing Sheets

(56) References Cited

U.S. PATENT DOCUMENTS

| | | | | |
|---|---|---|---|---|
| 9,402,371 | B2 | 8/2016 | Rabideau | |
| 10,160,578 | B2 * | 12/2018 | Harvey | B65D 25/34 |
| 11,084,624 | B1 * | 8/2021 | Allen | B65D 21/04 |
| 2011/0278315 | A1 * | 11/2011 | Bower | A47G 19/2261 220/703 |
| 2014/0042158 | A1 * | 2/2014 | Witkowski | B65D 81/3216 220/4.01 |

* cited by examiner

CONTAINER SYSTEM

CROSS-REFERENCE TO RELATED APPLICATIONS

This application claims the benefit of U.S. Provisional Patent Application No. 63/083,529, filed Sep. 25, 2020, the content of which is incorporated herein by reference in its entirety.

BACKGROUND

Current container systems include a container for carrying contents and a lid for sealing those contents in the container. When the contents of the container need to be accessed, the lid is removed. The lid then becomes a hinderance because it can be easily misplaced and difficult to replace if it is misplaced. Also, many conventional lids only serve the purpose of sealing the container. Thus, a need exists for a container system with a multipurpose lid that can be coupled to the container when the lid is not being used to seal the container.

SUMMARY

Various implementations include a container system that includes a first bowl and a second bowl. The first bowl has a first base and a resilient wall. The first base has a surface. The resilient wall extends at least partially in an axial direction from the first base. An edge of the resilient wall is spaced apart from the first base and defines an opening to the first bowl. The resilient wall has an inner surface that faces a central longitudinal axis that extends through the first base. The surface of the first base faces the opening of the first bowl. The resilient wall is urgable radially outwardly from the central longitudinal axis of the first bowl from a resting position to an expanded position. The edge of the resilient wall has a resting perimeter length when the resilient wall is in the resting position and an expanded perimeter length when the resilient wall is in the expanded position. The second bowl has a second base and a rigid wall. The second base has a surface. The rigid wall extends at least partially in an axial direction from the second base. The rigid wall has a first edge spaced apart from the second base and a second edge opposite and spaced apart from the first edge of the rigid wall. The first edge of the rigid wall defines an opening to the second bowl. The rigid wall has an inner surface that faces a central longitudinal axis that extends through the second base. The surface of the second base faces the opening of the second bowl. The first edge of the rigid wall has a first perimeter length. The second edge of the rigid wall has a second perimeter length. The first perimeter length and the second perimeter length of the rigid wall are greater than or equal to the resting perimeter length of the resilient wall and are less than or equal to the expanded perimeter length of the resilient wall. At least one groove is defined by, and extends in a circumferential direction along, one of the inner surface of the resilient wall and/or the outer surface of the rigid wall. At least one protrusion extends in a circumferential direction along the other of the outer surface of the rigid wall and/or the inner surface of the resilient wall. The at least one protrusion is engageable within the at least one groove.

In some implementations, the inner surface of the resilient wall defines the at least one groove, and the at least one protrusion extends from the outer surface of the rigid wall. In some implementations, the at least one protrusion has a protrusion perimeter length, and the protrusion perimeter length is less than or equal to the expanded perimeter of the resilient wall.

In some implementations, the outer surface of the rigid wall defines the at least one circumferentially extending groove, and the at least one protrusion extends circumferentially from the inner surface of the resilient wall. In some implementations, the protrusion has an expanded protrusion perimeter length when the resilient wall is in the expanded position, and the expanded protrusion perimeter length is greater than or equal to the first perimeter length and the second perimeter length of the rigid wall.

In some implementations, the at least one circumferentially extending groove includes at least two circumferentially extending grooves, and the at least one protrusion includes at least two protrusions. In some implementations, the at least two protrusions include at least a first protrusion and a second protrusion. The first protrusion extends circumferentially from the inner surface of the resilient wall and the second protrusion extends from the outer surface of the rigid wall. The at least two grooves include at least a first groove and a second groove. The outer surface of the rigid wall defines the first groove and the inner surface of the resilient wall defines the second groove. In some implementations, the at least two protrusions include at least a first protrusion and a second protrusion. The first protrusion and the second protrusion extend circumferentially from one of the inner surface of the resilient wall or the outer surface of the rigid wall. The at least two grooves include at least a first groove and a second groove. The first groove and the second groove are defined by the other of the outer surface of the rigid wall or the inner surface of the resilient wall.

In some implementations, the expanded perimeter length is an expanded circumference length, the first perimeter length is a first circumference length, the second perimeter length is a second circumference length, and the expanded circumference length is greater than or equal to the first circumference length and the second circumference length.

In some implementations, the groove has a groove axial width and the protrusion has a protrusion axial width. The groove axial width and the protrusion axial width are equal to each other.

In some implementations, the groove has a groove axial width and the protrusion has a protrusion axial width. The protrusion axial width is smaller than the groove axial width.

In some implementations, the first base includes a resilient material.

In some implementations, the first base and the resilient wall include a silicone rubber material.

In some implementations, the second base includes a rigid material.

In some implementations, the second base and the second wall include stainless steel.

In some implementations, at least a portion of the rigid wall of the second bowl is disposable within at least a portion of the resilient wall of the first bowl such that the surface of the second base faces the surface of the first base, and the bowls define a closed cavity. The portion of the rigid wall abuts the portion of the resilient wall to form a fluid-tight seal when the portion of the rigid wall is disposed within the portion of the resilient wall. In some implementations, the fluid-tight seal is an air-tight seal.

In some implementations, the second base of the second bowl is disposable within the first bowl such that the surface of the second base and the surface of the first base face a same direction.

DETAILED DESCRIPTION

The devices, systems, and methods disclosed herein provide for a container system that includes a first bowl and a second bowl. The first bowl includes a resilient wall with an inner surface that defines a groove. The second bowl includes a rigid wall with an outer surface that has a protrusion. The resilient wall of the first bowl is configured such that the resilient wall is urgable radially outward to fit around the rigid wall of the second bowl such that the groove of the resilient wall is engaged with the protrusion of the rigid wall in either a covering configuration or a nesting configuration.

Various implementations include a container system that includes a first bowl and a second bowl. The first bowl has a first base and a resilient wall. The first base has a surface. The resilient wall extends at least partially in an axial direction from the first base. An edge of the resilient wall is spaced apart from the first base and defines an opening to the first bowl. The resilient wall has an inner surface that faces a central longitudinal axis that extends through the first base. The surface of the first base faces the opening of the first bowl. The resilient wall is urgable radially outwardly from the central longitudinal axis of the first bowl from a resting position to an expanded position. The edge of the resilient wall has a resting perimeter length when the resilient wall is in the resting position and an expanded perimeter length when the resilient wall is in the expanded position. The second bowl has a second base and a rigid wall. The second base has a surface. The rigid wall extends at least partially in an axial direction from the second base. The rigid wall has a first edge spaced apart from the second base and a second edge opposite and spaced apart from the first edge of the rigid wall. The first edge of the rigid wall defines an opening to the second bowl. The rigid wall has an inner surface that faces a central longitudinal axis that extends through the second base. The surface of the second base faces the opening of the second bowl. The first edge of the rigid wall has a first perimeter length. The second edge of the rigid wall has a second perimeter length. The first perimeter length and the second perimeter length of the rigid wall are greater than or equal to the resting perimeter length of the resilient wall and are less than or equal to the expanded perimeter length of the resilient wall. At least one groove is defined by, and extends in a circumferential direction along, one of the inner surface of the resilient wall and/or the outer surface of the rigid wall. At least one protrusion extends in a circumferential direction along the other of the outer surface of the rigid wall and/or the inner surface of the resilient wall. The at least one protrusion is engageable within the at least one groove.

Figure 1:
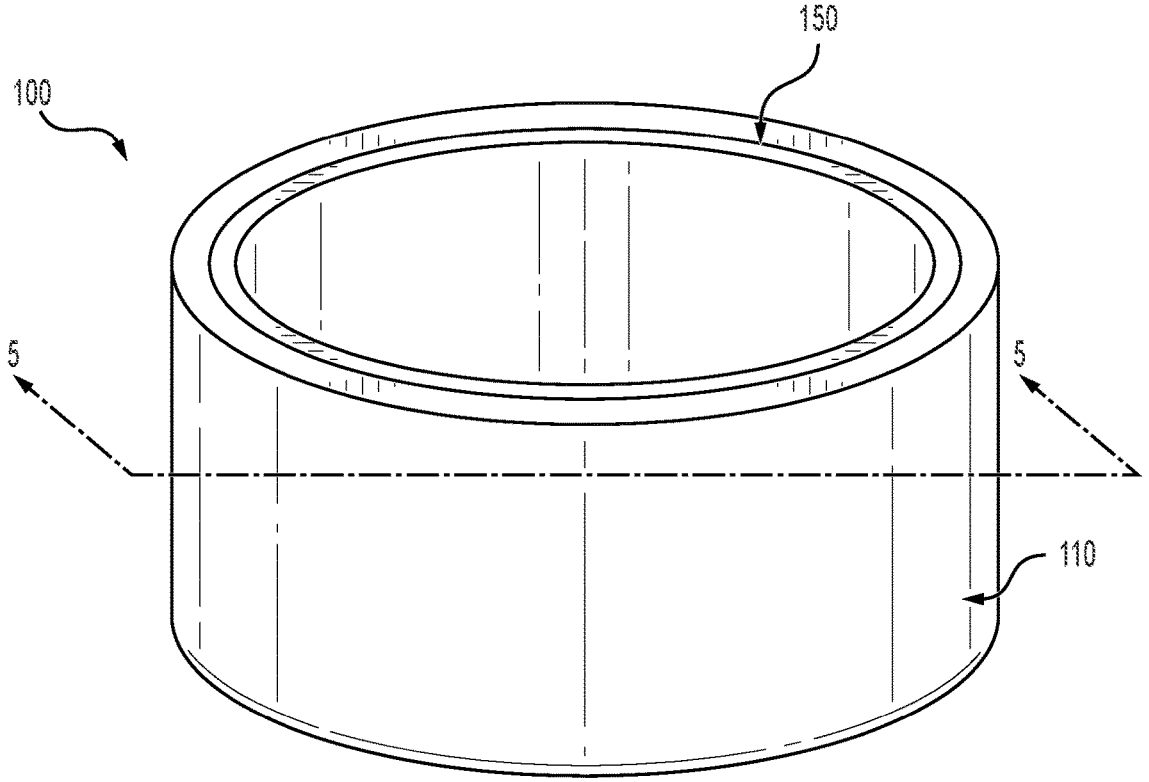
FIG. 1 is a perspective view of the top of a container system in a nesting configuration in accordance with one implementation.
Figure 2:
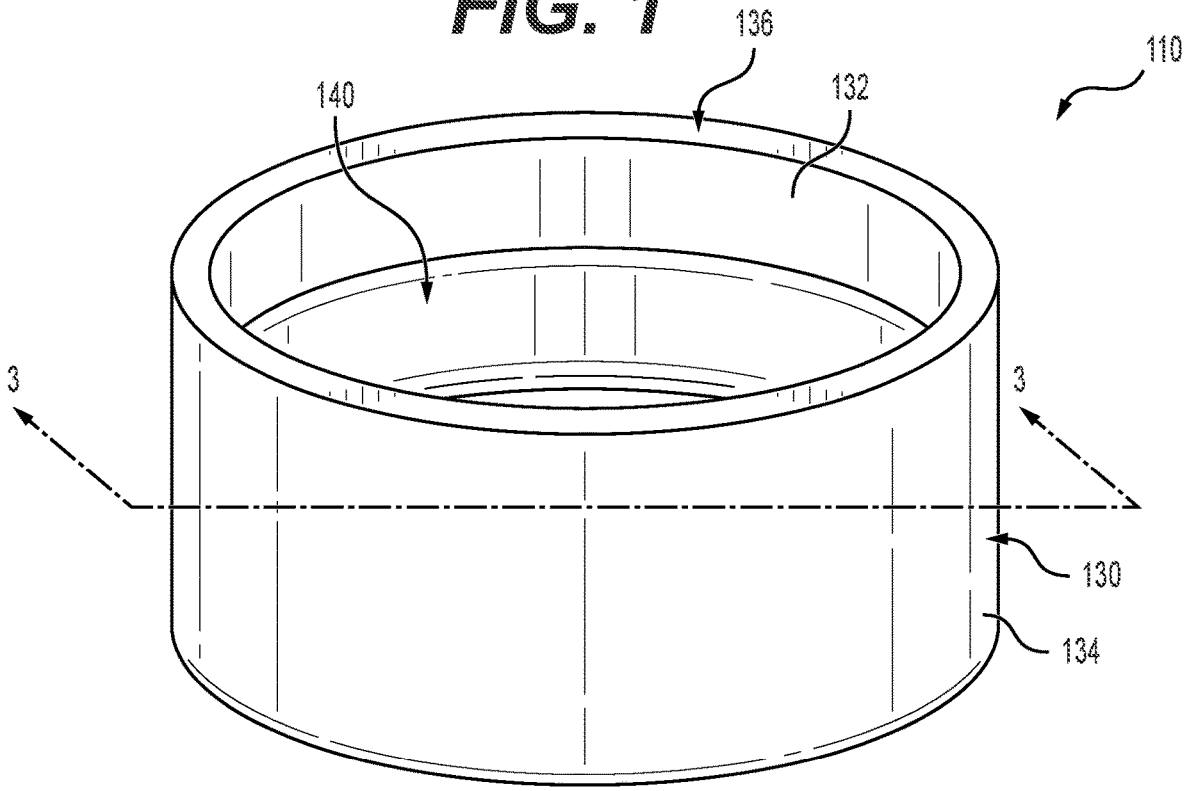
FIG. 2 is a perspective view of a first bowl of the container system of FIG. 1.

FIG. 1 illustrates an example of a container system 100 including a first bowl 110 and a second bowl 150. FIG. 2 illustrates the first bowl 110 of the container system 100. The first bowl 110 has a first base 120, a resilient wall 130, and a central longitudinal axis 128 that extends through the first base 120.

The first base 120 has a first surface 122 and a second surface 124 opposite and spaced apart from the first surface 122. The first base 120, first surface 122, and second surface 124 are circular, but in other implementations, the first base, first surface, and second surface have other suitable closed shapes, such as square, rectangular, hexagonal, or oval. An outer edge 126 of the first base 120 extends between the first surface 122 and the second surface 124.

The resilient wall 130 extends in an axial direction from the first base 120. The resilient wall 130 is an annular shape as viewed in a plane parallel to the first surface 122 of the first base 120. The resilient wall 130 extends from the outer edge 126 of the first base 120. The resilient wall 130 has an inner surface 132 and an outer surface 134. The outer surface 134 of the resilient wall 130 is spaced radially outwardly from the inner surface 132 of the resilient wall 130. The inner surface 132 of the resilient wall 130 faces the central longitudinal axis 128 of the first bowl 110. An edge 136 of the resilient wall 130 is spaced apart from the first base 120. The edge 136 of the resilient wall 130 defines an opening to the first bowl 110. The first surface 122 of the first base 120 faces the opening of the first bowl 110. The inner surface 132 of the resilient wall 130 and the first surface 122 of the first base 120 define a first cavity.

Figure 3:
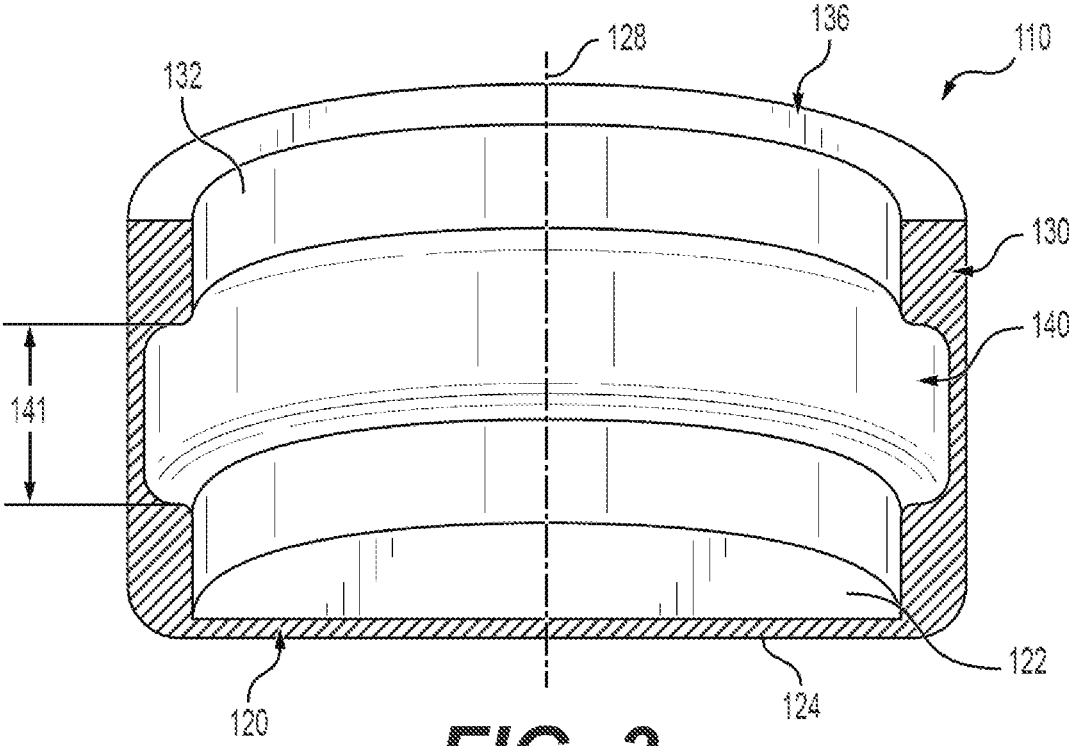
FIG. 3 is a center cross-sectional view of the first bowl of FIG. 2 as viewed from line 3-3.

The inner surface 132 of the resilient wall 130 defines at least one groove 140. The groove 140 extends continuously in a circumferential direction along the entire perimeter of the inner surface 132 of the resilient wall 130. As seen in FIG. 3, the groove 140 has a semi-rectangular shape as viewed in a cross-sectional plane that includes the central longitudinal axis 128 of the first bowl 110. The groove 140 also has a groove axial width 141.

The resilient wall 130 is urgable radially outwardly from the central longitudinal axis 128 of the first bowl 110 from a resting position to an expanded position. The edge 136 of the resilient wall 130 has a resting perimeter length when the resilient wall 130 is in the resting position and an expanded perimeter length when the resilient wall 130 is in the expanded position. Because the resilient wall 130 shown in FIGS. 1-3, 5 and 6 is an annular shape, the resting perimeter length and the expanded perimeter length of the edge 136 of the resilient wall 130 are a resting circumference length and an expanded circumference length, respectively.

In other implementations, the resilient wall has any suitable closed shape, as viewed in a plane parallel to the first surface of the first base, such that the shape of the resilient wall corresponds to the shape of the first base. For example, the shape of the first base and the shape of the resilient wall, as viewed in a plane parallel to the first surface of the first base, is any suitable closed shape, such as square, rectangle, hexagonal, or oval. In some implementations, the groove can have any cross-sectional shape such as semi-circular or semi-square. In addition, in other implementations, the resilient wall may be spaced radially inwardly from the outer edge of the first base.

The first base 120 and the resilient wall 130 both include a silicone rubber material. However, in other implementations, only the first base, only the resilient wall, or neither the resilient wall or first base includes a silicone rubber material. And, in other implementations, the resilient wall, the first base, or both include a polymer, rubber, plastic, and/or other resilient material. In other implementations, first base includes a metal, a plastic, and/or any other rigid material.

Figure 4:
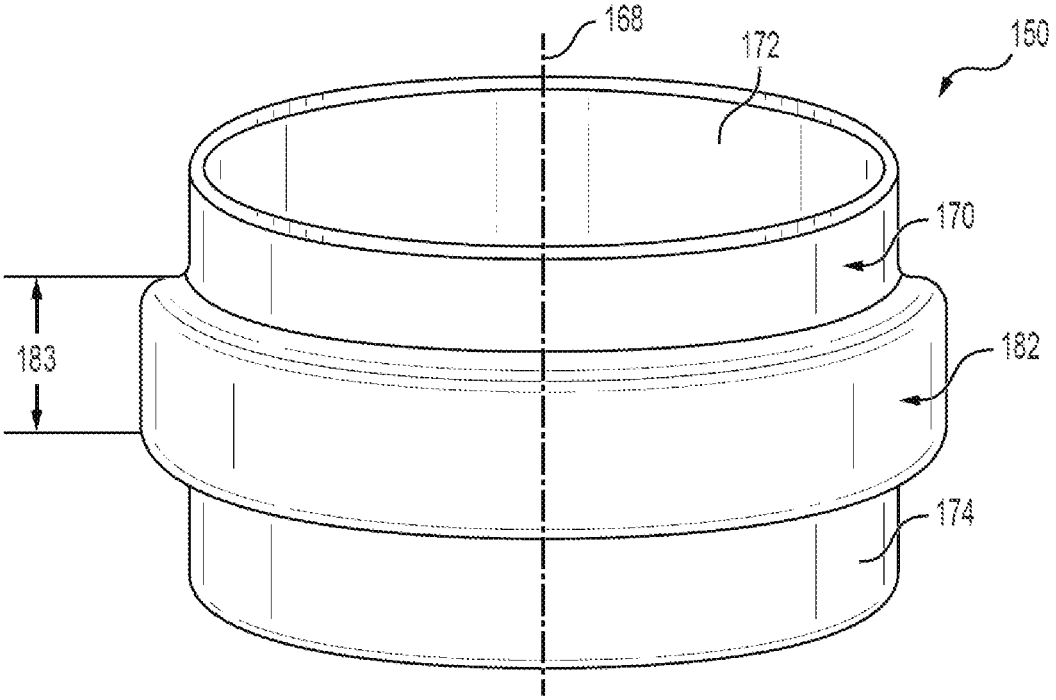
FIG. 4 is a perspective view of a second bowl of the container system of FIG. 1.

FIG. 4 illustrates the second bowl 150 of the container system 100. The second bowl 150 has a second base 160, a rigid wall 170, and a central longitudinal axis 168 that extends through the second base 160.

The second base 160 has a first surface 162 and a second surface 164 opposite and spaced apart from the first surface 162. The second base 160, first surface 162, and second surface 164 are circular, but in other implementations, the second base, first surface, and second surface have other are suitable closed shapes, such as square, rectangular, hexagonal, or oval. An outer edge 176 of the second base 160 extends between the first surface 162 and the second surface 164.

The rigid wall 170 extends in an axial direction from the second base 160. The rigid wall 170 is an annular shape as viewed in a plane parallel to the first surface 162 of the second base 160. The rigid wall 170 extends from the outer edge 176 of the second base 160. The rigid wall 170 has an inner surface 172 and an outer surface 174. The outer surface 174 of the rigid wall 170 is spaced radially outwardly from the inner surface 172 of the rigid wall 170. The inner surface 172 of the rigid wall 170 faces the central longitudinal axis 168 of the second bowl 150. The rigid wall 170 has a first edge 176 spaced apart from the second base 160 and a second edge 178 opposite and spaced apart from the first edge 176. The first edge 176 of the rigid 170 wall defines an opening to the second bowl 150. The first surface 162 of the second base 160 faces the opening of the second bowl 150. The inner surface 172 of the rigid wall 170 and the first surface 162 of the second base 160 define a second cavity.

Figure 5:
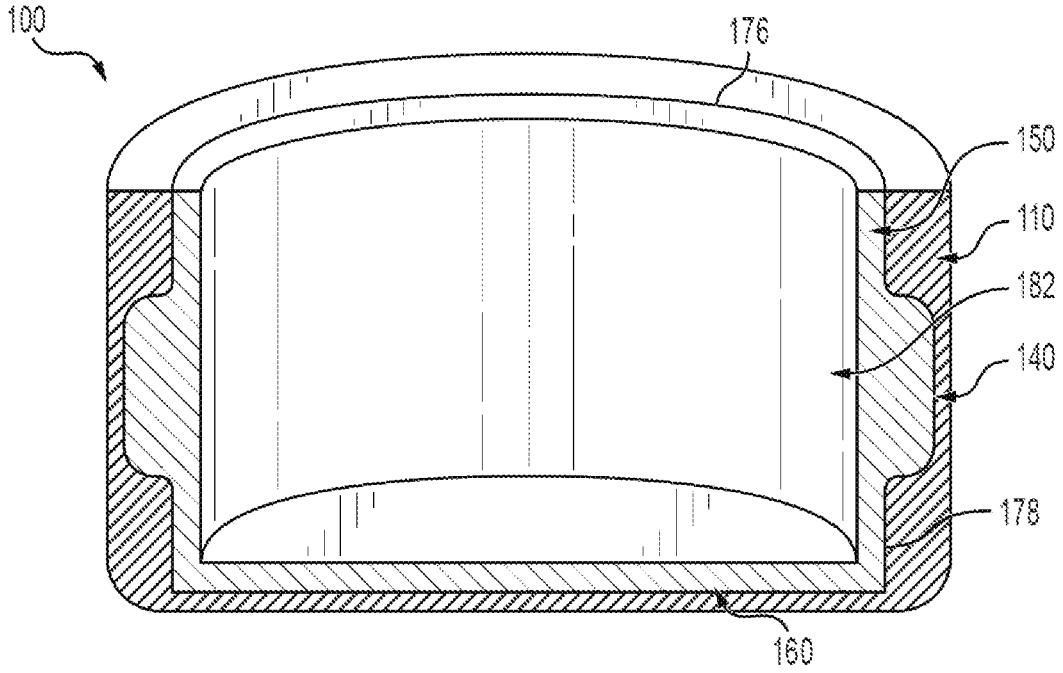
FIG. 5 is a center cross-sectional view of the container system of FIG. 1 in the nesting configuration.

The outer surface 174 of the rigid wall 170 defines at least one protrusion 182. The protrusion 182 extends continuously in a circumferential direction along the entire circumference of the outer surface 174 of the rigid wall 170. As seen in FIG. 5, the protrusion 182 has a semi-rectangular shape as viewed in a cross-sectional plane that includes the central longitudinal axis that extends through the second base. The protrusion 182 also has a protrusion axial width 183 and a protrusion perimeter length. The protrusion 182 of the rigid wall 170 is engageable with the groove 140 of the resilient wall 130, and the protrusion axial width 183 is smaller than the groove axial width 141. Furthermore, the protrusion perimeter length is less than or equal to the expanded perimeter of the resilient wall 130. In some implementations, the protrusion axial width 183 is equal to the groove axial width 141.

The first edge 176 of the rigid wall 170 has a first perimeter length and the second edge of the rigid wall has a second perimeter length. The first perimeter length and the second perimeter length of the rigid wall 170 are greater than or equal to the resting perimeter length of the resilient wall 130 and are less than or equal to the expanded perimeter length of the resilient wall 130.

Because the rigid wall 170 shown in FIGS. 1, 4, and 5 has an annular shape, the first perimeter length of the first edge 176 and the second perimeter length of the second edge 178 of the rigid wall 170 are a first circumference length and a second circumference length, respectively.

In other implementations, the rigid wall has any suitable closed shape, as viewed in a plane parallel to the first surface of the second base, such that the shape of the rigid wall corresponds to the shape of the second base. For example, the shape of the second base and the shape of the rigid wall, as viewed in a plane parallel to the first surface of the first base, is any suitable closed shape, such as square, rectangle, hexagonal, or oval. In some implementations, the protrusion can have any cross-sectional shape such as semi-circular or semi-square. In addition, in other implementations, the rigid wall may be spaced radially inwardly from the outer edge of the second base.

The second base 160 and the rigid wall 170 both include a stainless-steel material. However, in other implementations, only the second base, only the rigid wall, or neither the rigid wall or second base includes a stainless steel material. In other implementations, the rigid wall, the second base, or both include a metal, plastic, and/or other rigid material. In other implementations, the second base includes a polymer, rubber, plastic, and/or other resilient material.

When the resilient wall 130 of the first bowl 110 is urged to the expanded perimeter length, the perimeter of the first bowl 110 is larger than the first perimeter length, the second perimeter length, and the protrusion perimeter length of the second bowl 150. Thus, the rigid wall 170 of the second bowl 150 can be disposed within the resilient wall 130 of the first bowl 110 such that the second bowl 150 is disposed inside the first cavity of the first bowl 110.

In the nesting configuration, the second bowl 150 is disposed within the first cavity of the first bowl 110 such that the first surface 122 of the first base 120 and the first surface 162 of the second base 160 face the same direction. The nesting configuration is illustrated in a perspective view in FIG. 1 and in a cross-section view in FIG. 5. In the nesting configuration, the second cavity of the second bowl 150 is accessible. The protrusion 182 of the rigid wall 170 is engaged with the groove 140 of the resilient wall 130 to secure the second bowl 150 inside of the first cavity of the first bowl 110.

Figure 6:
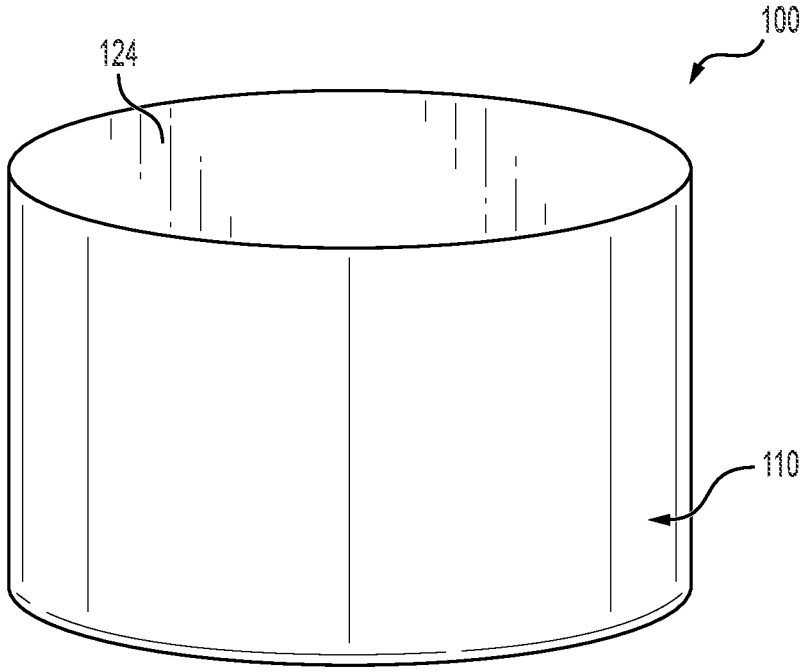
FIG. 6 is a perspective view of the top of the container system of FIG. 1 in a covering configuration.
Figure 7:
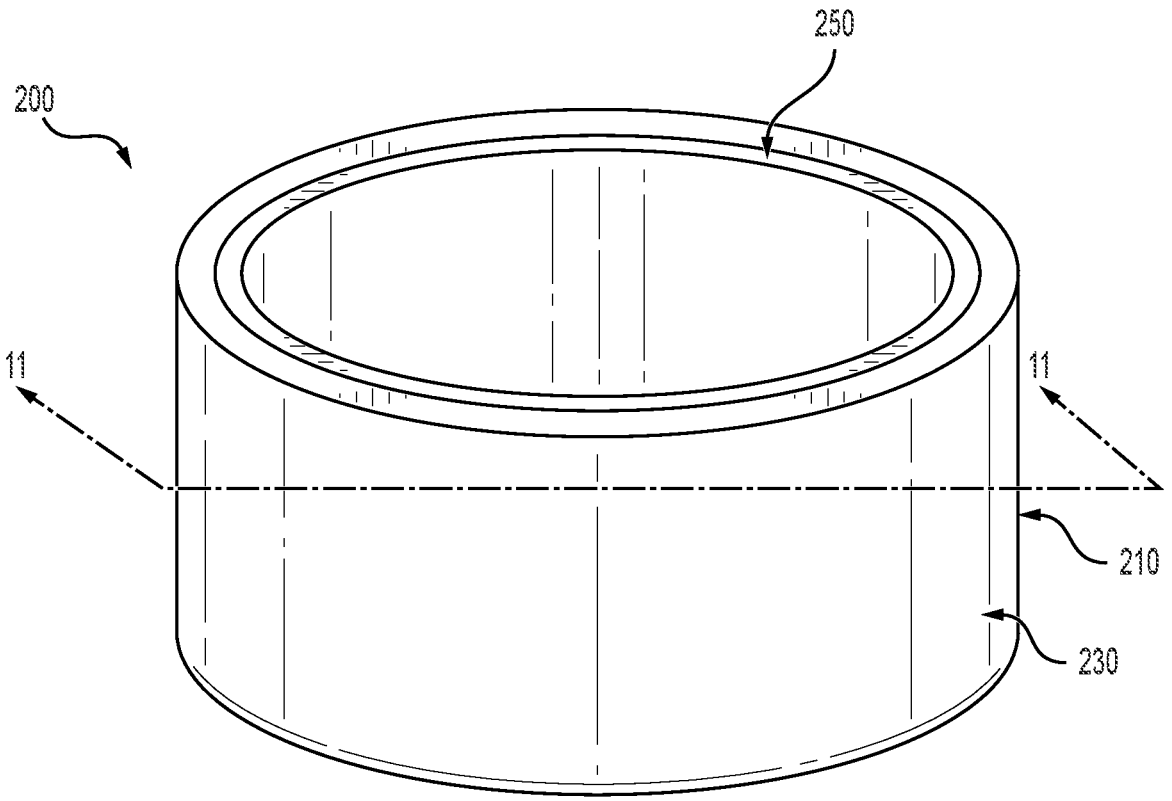
FIG. 7 is a perspective view of the top of another implementation of a container system in a nesting configuration.
Figure 8:
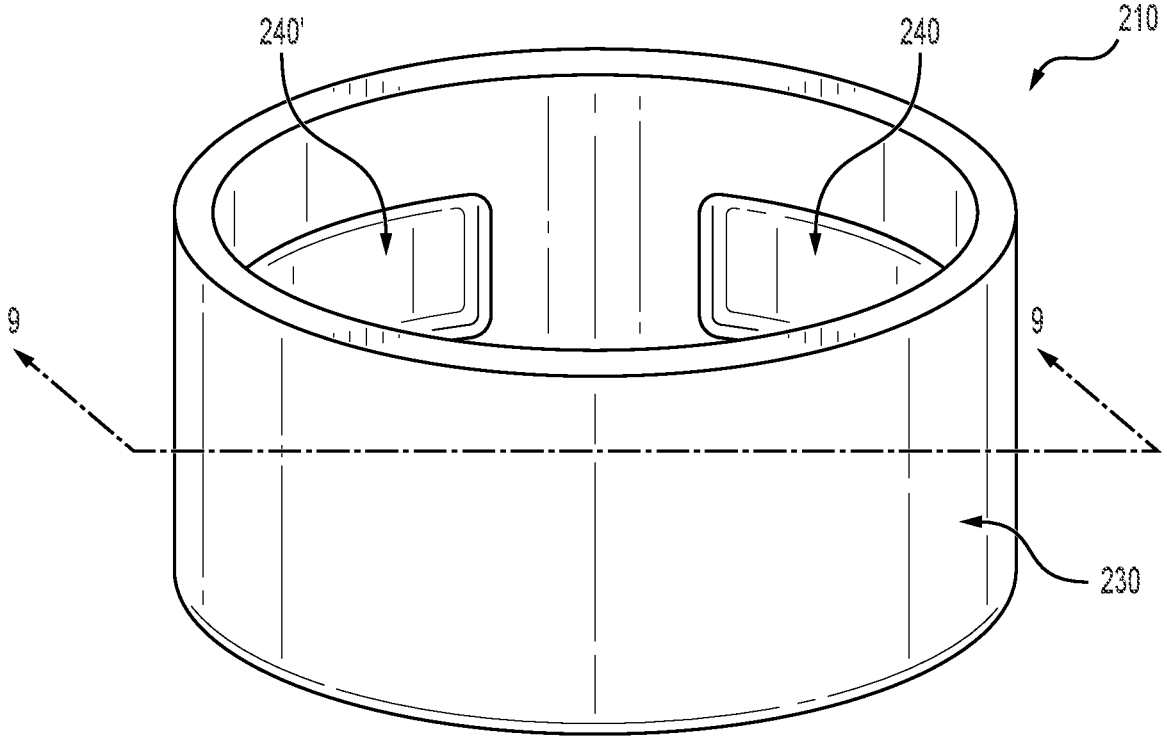
FIG. 8 is a perspective view of the top of another implementation of a first bowl of the container system of FIG. 7.
Figure 9:
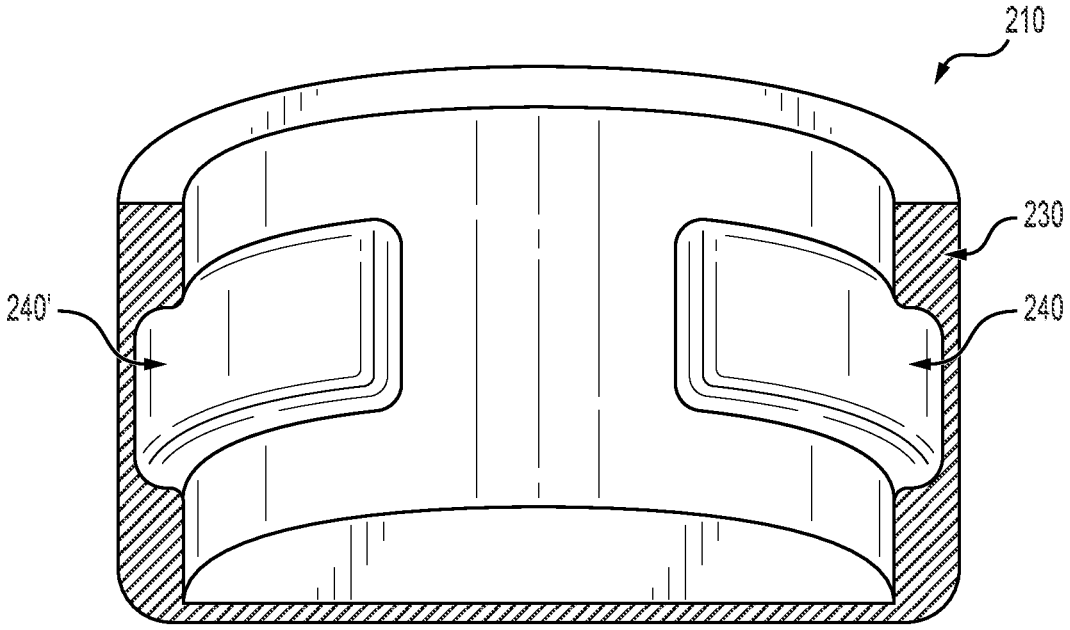
FIG. 9 is a center cross-sectional view of the first bowl of FIG. 8 as viewed from line 9-9.
Figure 10:
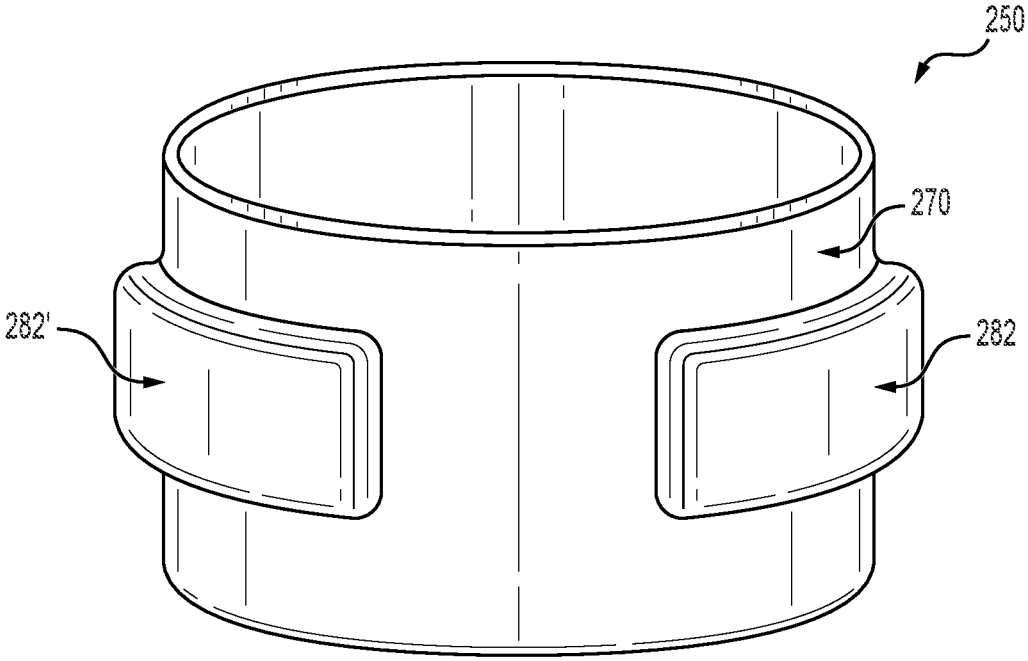
FIG. 10 is a perspective view of the top of another implementation of a second bowl of the container system of FIG. 7.
Figure 11:
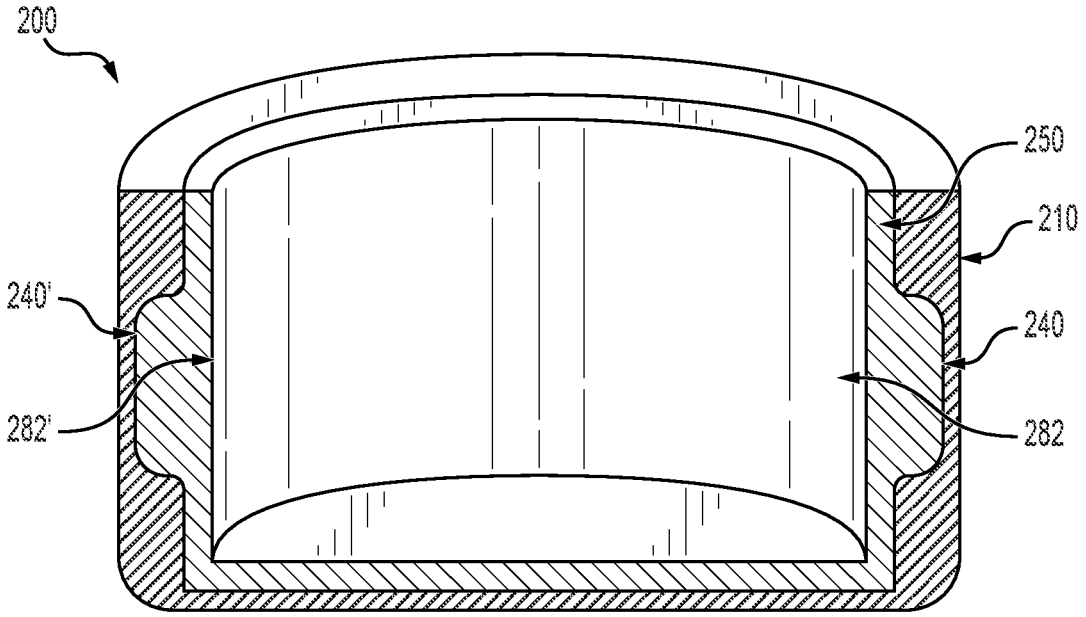
FIG. 11 is a center cross-sectional view of the container system of FIG. 7 as viewed form line 11-11.
Figure 12:
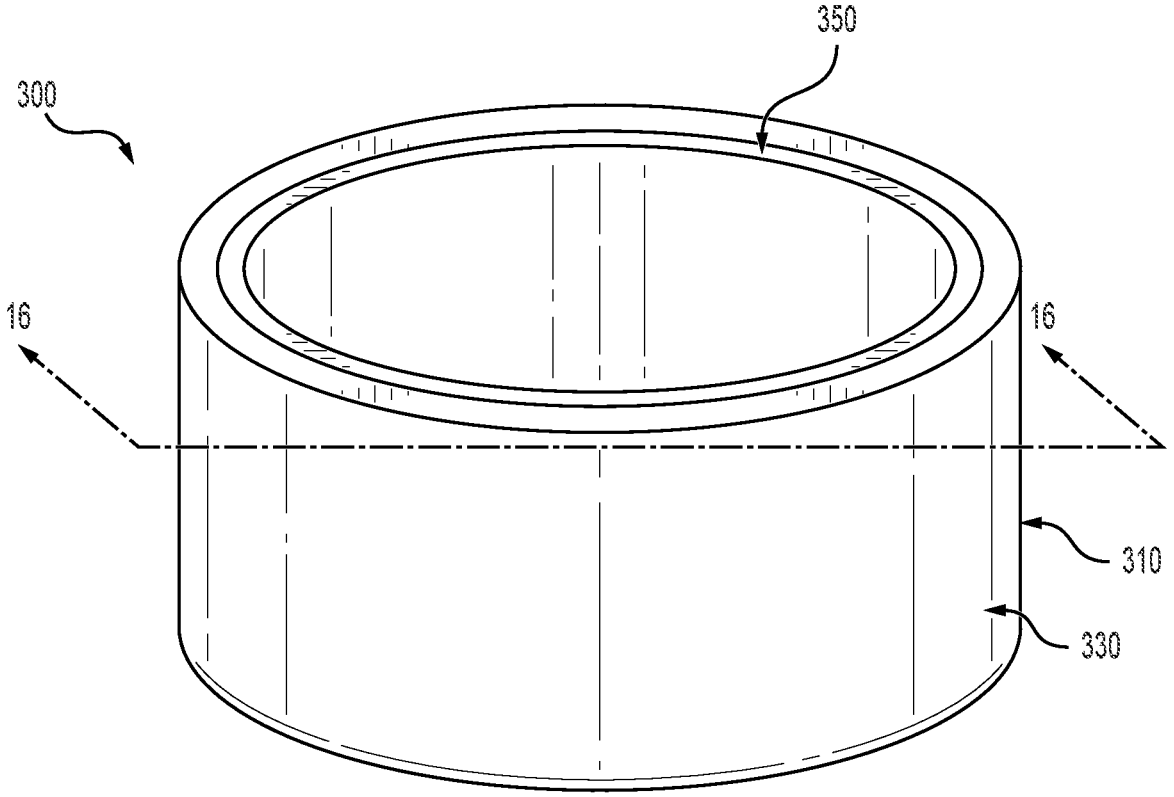
FIG. 12 is a perspective view of the top of another implementation of a container system in a nesting configuration
Figure 13:
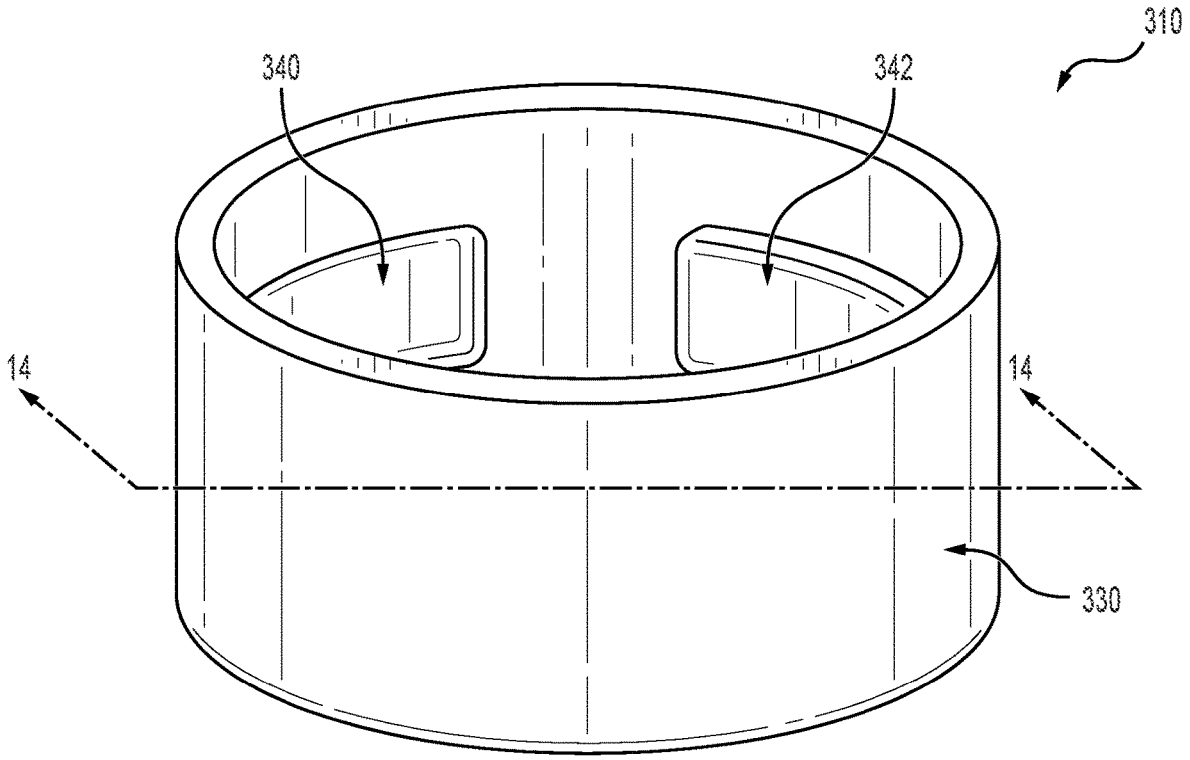
FIG. 13 is a perspective view of the top of another implementation of a first bowl of the container system of FIG. 12.
Figure 14:
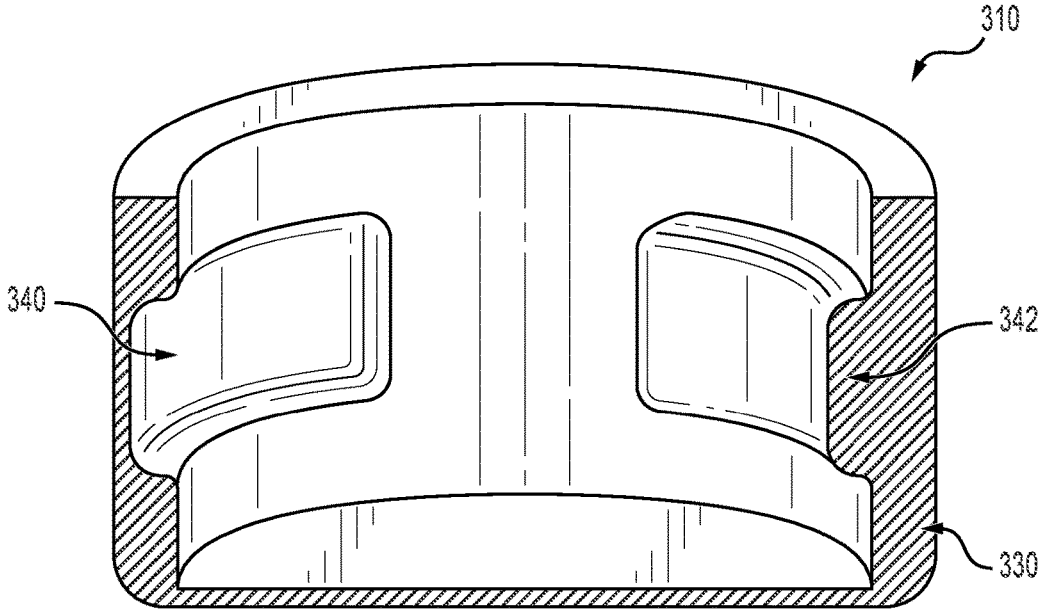
FIG. 14 is a center cross-sectional view of the first bowl of FIG. 13 as viewed from line 14-14.
Figure 15:
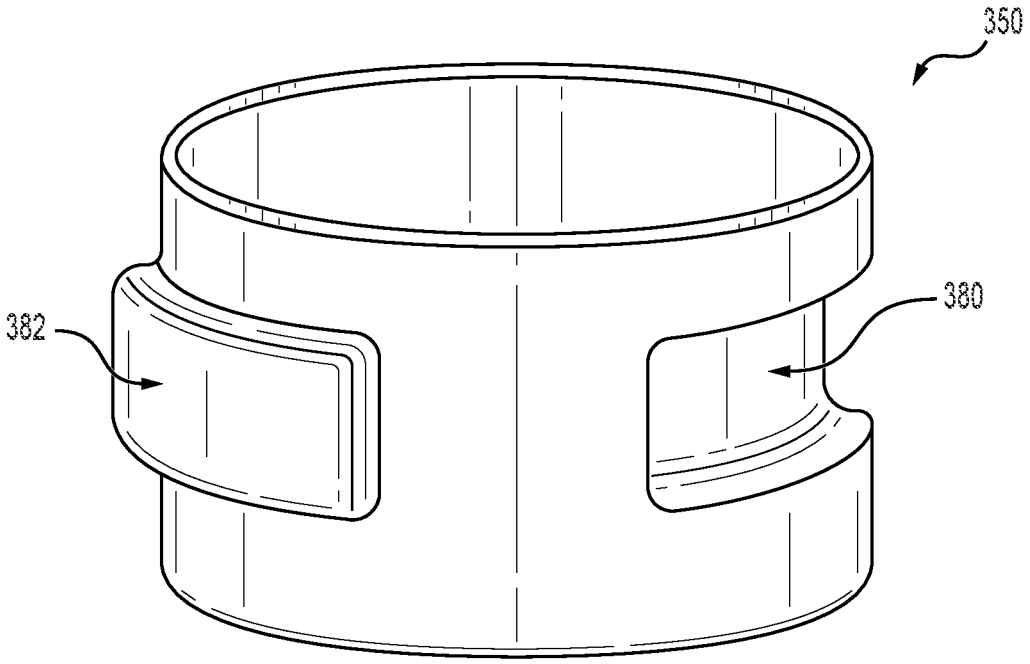
FIG. 15 is a perspective view of the top of another implementation of a second bowl of the container system of FIG. 12.
Figure 16:
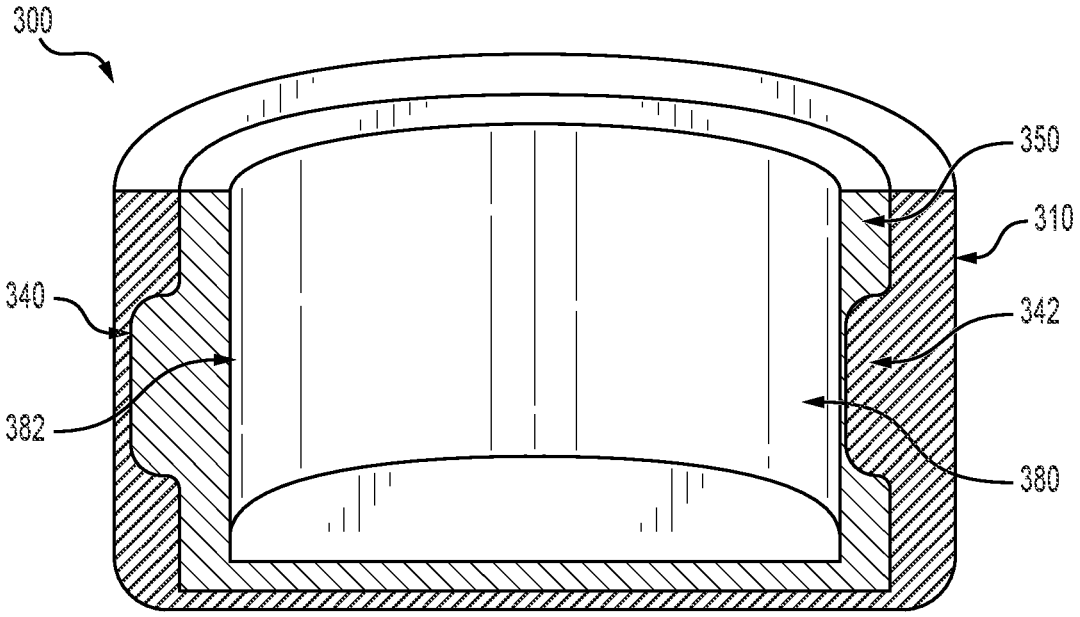
FIG. 16 is a center cross-sectional view of the container system of FIG. 12 as viewed form line 16-16.

In the covering configuration, the second bowl 150 is disposed within the first cavity of the first bowl 110 such that the first surface 122 of the first base 120 and the first surface 162 of the second base 160 face each other. The covering configuration is shown in FIG. 6. In the covering configuration, neither the first cavity of the first bowl 110 nor the second cavity of the second bowl 150 is accessible. The protrusion 182 of the rigid wall 170 is engaged with the groove 140 of the resilient wall 130 to secure the second bowl 150 inside the first cavity of the first bowl 110. The rigid wall 170 of the second bowl 150 in FIG. 6 abuts the resilient wall 130 of the first bowl 110 to form a liquid-tight seal. The seal may also be air-tight.

The first bowl 110 and the second bowl 150 can be used together in the aforementioned configurations or used separately. In some implementations, the first bowl is used as a water bowl and the second bowl is used as a food bowl or vice versa. In some implementations, the covering configuration is used to secure food inside of the second bowl for facilitating transportation of the food and/or preventing the food from becoming stale or spoiled.

In other implementations, the resilient wall defines a protrusion along the entire perimeter of the inner surface of the resilient wall, and the outer surface of the rigid wall defines a groove along the entire perimeter of the rigid wall. In other implementations, the resilient wall defines any number of protrusions and/or grooves, and the rigid wall also defines any number of protrusions and/or grooves such that the second bowl is able to be disposed and secured in the first cavity of the first bowl.

FIGS. 7-11 illustrate another implementation of the container system 200. The container system 200 shown in FIGS. 7-11 is similar to the container system 100 shown in FIG. 1, but in the implementation shown in FIGS. 7-11, the resilient wall 230 of the first bowl 210 defines two grooves 240, 240', and the rigid wall 270 of the second bowl 250 defines two protrusions 282, 282'. For the nesting and covering configurations, each of the two protrusions 282, 282' of the rigid wall 270 are disposed in separate grooves 240, 240' of the resilient wall 230.

FIGS. 12-16 illustrate yet another implementation of the container system 300. The container system 300 shown in FIGS. 12-16 is similar to the container system 100 shown in FIG. 1, but in the implementation shown in FIGS. 12-16, the resilient wall 330 of the first bowl 310 defines a groove 340 and protrusion 342, and the rigid wall 370 of the second bowl 350 also defines a groove 380 and a protrusion 382. For the nesting and covering configurations, the protrusion 382 of the rigid wall 370 is disposed in the groove 340 of the resilient wall 330, and the protrusion 342 of the resilient wall 330 is disposed in the groove 382 of the rigid wall 370.

Although the protrusions and grooves shown in the implementations disclosed herein are axially centered along either the resilient wall and/or the rigid wall, in other implementations, the protrusion(s) and/or the groove(s) can be disposed at any axial position of the resilient wall and/or the rigid wall such that either the first bowl or the second bowl may be partially nested within the other bowl in the nesting and/or the covering configurations.

A number of implementations have been described. Nevertheless, it will be understood that various modifications may be made without departing from the spirit and scope of the claims. Accordingly, other implementations are within the scope of the following claims.

Certain terminology is used herein for convenience only and is not to be taken as a limitation on the present claims. In the drawings, the same reference numbers are employed for designating the same elements throughout the several figures. A number of examples are provided, nevertheless, it will be understood that various modifications can be made without departing from the spirit and scope of the disclosure herein. As used in the specification, and in the appended claims, the singular forms "a," "an," "the" include plural referents unless the context clearly dictates otherwise. The term "comprising" and variations thereof as used herein is used synonymously with the term "including" and variations thereof and are open, non-limiting terms. Although the terms "comprising" and "including" have been used herein to describe various implementations, the terms "consisting essentially of" and "consisting of" can be used in place of "comprising" and "including" to provide for more specific implementations and are also disclosed.

Disclosed are materials, systems, devices, methods, compositions, and components that can be used for, can be used in conjunction with, can be used in preparation for, or are products of the disclosed methods, systems, and devices. These and other components are disclosed herein, and it is understood that when combinations, subsets, interactions, groups, etc. of these components are disclosed that while specific reference of each various individual and collective combinations and permutations of these components may not be explicitly disclosed, each is specifically contemplated and described herein. For example, if a device is disclosed and discussed each and every combination and permutation of the device, and the modifications that are possible are specifically contemplated unless specifically indicated to the contrary. Likewise, any subset or combination of these is also specifically contemplated and disclosed. This concept applies to all aspects of this disclosure including, but not limited to, steps in methods using the disclosed systems or devices. Thus, if there are a variety of additional steps that can be performed, it is understood that each of these additional steps can be performed with any specific method steps or combination of method steps of the disclosed methods, and that each such combination or subset of combinations is specifically contemplated and should be considered disclosed.

What is claimed is:

1. A container system, the system comprising:

a first bowl comprising:

a first base having a first surface and a second surface opposite and spaced apart from the first surface, and a resilient wall, the resilient wall extending at least partially in an axial direction from the first base, wherein an edge of the resilient wall that is spaced apart from the first base defines an opening to the first bowl, and the resilient wall has an inner surface that faces a central longitudinal axis that extends through the first base, wherein the first surface of the first base faces the opening of the first bowl, wherein the resilient wall is urgable radially outwardly from the central longitudinal axis of the first bowl from a resting position to an expanded position, and wherein the edge of the resilient wall has a resting perimeter length when the resilient wall is in the resting position and an expanded perimeter length when the resilient wall is in the expanded position; and a second bowl comprising:

a second base having a first surface and a second surface opposite and spaced apart from the first surface, and a rigid wall, the rigid wall extending at least partially in an axial direction from the second base, wherein the rigid wall has a first edge spaced apart from the second base and a second edge opposite and spaced apart from the first edge of the rigid wall, wherein the first edge defines an opening to the second bowl, and the rigid wall has an inner surface that faces a central longitudinal axis that extends through the second base, wherein the first surface of the second base faces the opening of the second bowl, wherein the first edge of the rigid wall has a first perimeter length and the second edge of the rigid wall has a second perimeter length, wherein the first perimeter length and the second perimeter length of the rigid wall are greater than or equal to the resting perimeter length of the resilient wall and are less than or equal to the expanded perimeter length of the resilient wall, wherein at least one groove is defined by, and extends in a circumferential direction along, one of the inner surface of the resilient wall and/or an outer surface of the rigid wall, and at least one protrusion extends in a circumferential direction along the other of the outer surface of the rigid wall and/or the inner surface of the resilient wall, wherein the at least one protrusion is engageable within the at least one groove, and wherein the first and second bowls are alternatively arrangeable in a first configuration and a second configuration wherein at least a portion of the rigid wall of the second bowl is disposable within at least a portion of the resilient wall of the first bowl wherein, in the first configuration the first surface of the second base faces the first surface of the first base and the bowls define a closed cavity, and in the second configuration, the second surface of the second base faces the first surface of the first base, and wherein the portion of the rigid wall abuts the portion of the resilient wall to form a fluid-tight seal when the portion of the rigid wall is disposed within the portion of the resilient wall.

2. The system of claim 1, wherein the inner surface of the resilient wall defines the at least one groove, and the at least one protrusion extends from the outer surface of the rigid wall.

3. The system of claim 2, wherein the at least one protrusion has a protrusion perimeter length, and the protrusion perimeter length is less than or equal to the expanded perimeter of the resilient wall.

4. The system of claim 1, wherein the outer surface of the rigid wall defines the at least one circumferentially extending groove, and the at least one protrusion extends circumferentially from the inner surface of the resilient wall.

5. The system of claim 4, wherein the protrusion has an expanded protrusion perimeter length when the resilient wall is in the expanded position, and the expanded protrusion perimeter length is greater than or equal to the first perimeter length and the second perimeter length of the rigid wall.

6. The system of claim 1, wherein the at least one circumferentially extending groove comprises at least two circumferentially extending grooves, and the at least one protrusion comprises at least two protrusions.

7. The system of claim 6, wherein the at least two protrusions comprise at least a first protrusion and a second protrusion, wherein the first protrusion extends circumferentially from the inner surface of the resilient wall and the second protrusion extends from the outer surface of the rigid wall, and wherein the at least two grooves comprise at least a first groove and a second groove, wherein the outer surface of the rigid wall defines the first groove and the inner surface of the resilient wall defines the second groove.

8. The system of claim 6, wherein the at least two protrusions comprise at least a first protrusion and a second protrusion, wherein the first protrusion and the second protrusion extend circumferentially from one of the inner surface of the resilient wall or the outer surface of the rigid wall, and wherein the at least two grooves comprise at least a first groove and a second groove, wherein the first groove and the second groove are defined by the other of the outer surface of the rigid wall or the inner surface of the resilient wall.

9. The system of claim 1, wherein:

the expanded perimeter length is an expanded circumference length, the first perimeter length is a first circumference length, the second perimeter length is a second circumference length, and the expanded circumference length is greater than or equal to the first circumference length and the second circumference length.

10. The system of claim 1, wherein the groove has a groove axial width and the protrusion has a protrusion axial width, and wherein the groove axial width and the protrusion axial width are equal to each other when the groove and the protrusion are not engaged.

11. The system of claim 1, wherein the groove has a groove axial width and the protrusion has a protrusion axial width, and wherein the protrusion axial width is smaller than the groove axial width when the groove and the protrusion are engaged.

12. The system of claim 1, wherein the first base comprises a resilient material.

13. The system of claim 1, wherein the first base and the resilient wall comprise a silicone rubber material.

14. The system of claim 1, wherein the second base comprises a rigid material.

15. The system of claim 1, wherein the second base and the second wall comprise stainless steel.

16. The system of claim 1, wherein the fluid-tight seal is an air-tight seal.

* * * * *